US005582505A

United States Patent [19]

Warth

[11] Patent Number: 5,582,505

[45] Date of Patent: Dec. 10, 1996

[54] BORE-HOLE PUMP

[75] Inventor: Helmut Warth, Ludwigshafen, Germany

[73] Assignee: KSB Aktiengesellschaft, Frankenthal, Germany

[21] Appl. No.: 433,395

[22] PCT Filed: Oct. 30, 1993

[86] PCT No.: PCT/EP93/03036

§ 371 Date: May 3, 1995

§ 102(e) Date: May 3, 1995

[87] PCT Pub. No.: WO94/10449

PCT Pub. Date: May 11, 1994

[30] Foreign Application Priority Data

Nov. 3, 1992 [DE] Germany ..... 42 37 050.7

[51] Int. Cl.[6] ..... F21B 34/10; F04D 15/00

[52] U.S. Cl. ..... 415/116; 415/147; 166/321

[58] Field of Search ..... 415/49, 116, 147, 415/151, 156, 157, 901; 417/432; 166/321

[56] References Cited

U.S. PATENT DOCUMENTS

| | | | |
|---|---|---|---|
| 1,493,509 | 5/1924 | Willey | 415/116 |
| 2,022,749 | 12/1935 | Taylor . | |
| 2,516,822 | 7/1950 | Yates | 415/147 |
| 2,567,513 | 9/1951 | Haines . | |
| 2,640,543 | 6/1953 | Childers . | |
| 2,812,721 | 11/1957 | Coberly . | |
| 2,853,017 | 9/1958 | Renson | 415/147 |
| 2,933,042 | 4/1960 | Scrivner . | |
| 3,007,524 | 11/1961 | Pistole et al. . | |
| 3,758,238 | 9/1973 | Erickson . | |
| 3,807,894 | 4/1974 | O'Rourke . | |
| 4,021,137 | 5/1977 | Zehren . | |
| 4,440,221 | 4/1984 | Taylor et al. | 166/321 |
| 4,721,162 | 1/1988 | Pringle et al. | 166/321 |
| 4,749,036 | 6/1988 | Read . | |

FOREIGN PATENT DOCUMENTS

| | | | |
|---|---|---|---|
| 0246943 | 11/1987 | European Pat. Off. . | |
| 2656035 | 6/1991 | France . | |
| 2243406 | 10/1991 | United Kingdom | 415/151 |

*Primary Examiner*—James Larson
*Attorney, Agent, or Firm*—Darby & Darby, P.C.

[57] ABSTRACT

A bore-hole pump for pumping a highly viscous fluid, into which is fed a solvent which has a low viscosity and which is miscible with the fluid. A shutoff device is disposed between an inlet of the bore-hole pump and an actual inlet of the pump part. The shut-off device is activated by the solvent.

6 Claims, 2 Drawing Sheets

BORE-HOLE PUMP

TECHNICAL FIELD

The invention relates to a bore-hole pump for pumping a viscous fluid, e.g. petroleum, from underground deposits. The bore-hole pump is lowered into a bore-hole until it is immersed in the fluid or into a fluid-carrying ground stratum. It thus fills with fluid. To facilitate pumping a viscous fluid, a low-viscosity solvent is added to the fluid in order to reduce its viscosity.

PRIOR ART

Such bore-hole pumps exist in a large number of designs. Pumps are used which are driven through linkages or driven directly by an electric motor, also turbo-pumps, that is pumps driven by turbines. One example of a turbo-pump is described in the EP-A-0 246 943, in which the driving liquid of the turbine is admixed to the pumped medium to reduce its viscosity.

However, all the above known bore-hole pumps have in common the disadvantage that, as they are lowered, fluid penetrates into the inlet of the bore-hole pump, and the pump part fills up. If the bore-hole pump is started when it is completely filled just with the highly viscous fluid, the starting torque is many times greater than the rated torque of a bore-hole pump for pumping a mixture of fluid and solvent. This must be taken into account in the design of the drive and of the torque-transmitting parts, to avoid difficulties in starting up the bore-hole pump. As a consequence, the drive is over-sized relative to normal operation, and larger dimensions and/or the use of higher-grade materials are needed to deal with the higher torques.

The invention is based on the task of remedying this disadvantage.

PRESENTATION OF THE INVENTION

This task is achieved in that a shutoff device is disposed between the inlet of the bore-hole pump and the actual inlet of the pump part. This has the advantage that, as the pump is lowered into the bore-hole, the pump part is closed, so that no viscous fluid can penetrate into the moving parts of the pump part.

The further development of claim 2 teaches the hydraulic activation of the shut-off device by the solvent. This type of activation has the advantage that the space required by the activation device can be kept small.

The shut-off device can be designed in the form of a hydraulically activated valve. A valve which has a rotationally symmetric through-flow cross-section is especially preferred.

In contrast to most conventional valves, in which the shut-off element moves in the flow direction while the valve opens, and moves counter to the flow direction while the valve closes, the further development of claim 4 is advantageous, according to which the valve is closed in the flow direction. The hydrostatic pressure in the bore-hole here reinforces the sealing action of the shut-off element, which is pressed into its seat. However, an essential advantage is that, with this design, the valve closes automatically when there is a sudden pressure drop in the solvent, e.g. because of break down of the pump at the surface. In the case of an accident, no undiluted, viscous petroleum can enter the pump part, which would make restart of the bore-hole pump difficult.

According to the further development of claim 5, the unloaded valve is closed by a reset means. This can be a spring. When the hydraulic piston is in its unloaded state, e.g. during entry of the bore-hole pump, the reset means assures reliable closure of the valve.

The further development of claim 6 has the advantage that the sealing action of the shut-off device is increased.

A turbo-pump as a bore-hole pump, as indicated in claim 7, has the advantage that the driving liquid of the turbine at the same time can be used as the solvent. The driving liquid is conducted to the turbine at high pressure, the pressure of the driving liquid being generated by a pump at the surface. It is possible to tap the pressure for activating the shut-off device at various points. Thus, the pressure prevailing at the entry of the turbine, as also the residual pressure present at the exit of the turbine, can be used. Furthermore, with a multi-stage turbine, it is possible to choose an intermediate tapping point after an arbitrary turbine stage between the entry and the exit of the turbine.

SHORT DESCRIPTION OF THE DRAWING

These and other properties, purposes, and advantages of the invention are presented and made apparent from the description in conjunction with the drawing.

WAYS TO IMPLEMENT THE INVENTION

Figure 1:
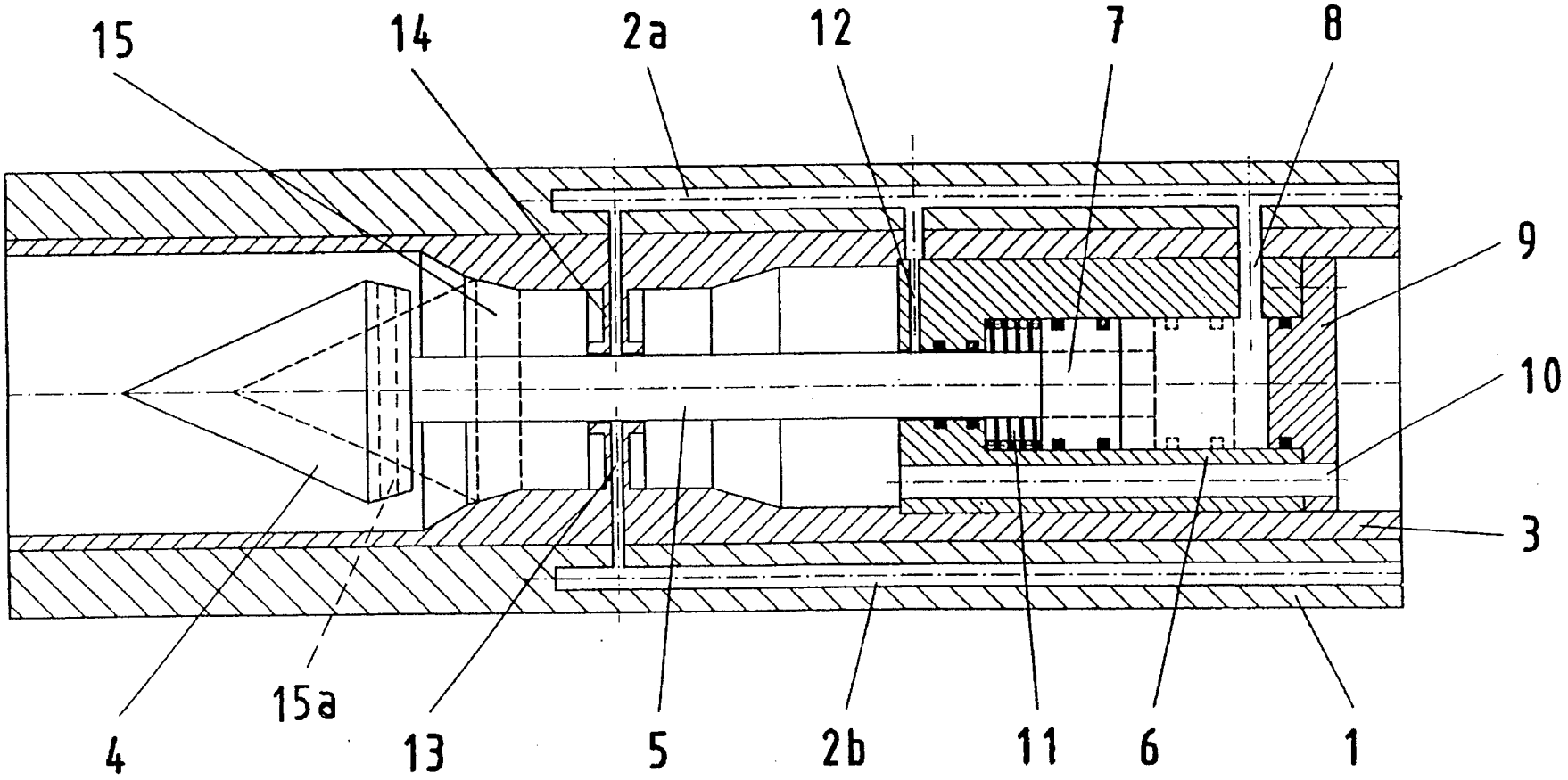
FIG. 1 shows a longitudinal section through the shut-off valve of a bore-hole pump.

The bore-hole pump partially shown in FIG. 1 has a case-housing (1) for accommodating various modules. The case housing (1) has longitudinal channels (2*a*, 2*b*) along its wall. The longitudinal channels (2*a*, 2*b*) make it possible to supply the modules with solvent under high pressure in order to perform the most various functions. With a turbo-pump, the drive fluid of the turbine or a partially decompressed component stream thereof goes through these longitudinal channels (2*a*, 2*b*). The drive fluid described here also serves as the solvent. One possible module is a shut-off device disposed at the lower end of the bore-hole pump. The module can be isolated without great effort from the rest of the bore-hole pump, and is connected to the case-housing (1), here, e.g. screwed on.

In the embodiment, the module which forms the shut-off device consists of a valve housing (3), which is guided in the case-housing (1), a valve-body (4), a piston rod (5), and a hydraulic actuation mechanism. The actuation mechanism is formed by a hydraulic cylinder (6), in which solvent is applied via a feed bore (8) to a hydraulic piston (7) that is connected to the piston rod (5). The hydraulic cylinder has a sealed cover (9) and has axial channels (10) in its housing wall, to let the fluid pass. The piston (7) divides the interior space bounded by the hydraulic cylinder (6) and the cover (9) into two chambers. In the first chamber, which faces the piston rod (5), there is a reset means in the form of a reset spring (11), which acts on the piston (7). However, it would also be conceivable to design this chamber as a cylinder chamber acted upon hydraulically, for resetting the piston.

The piston (7) and the piston rod (5) are sealed off. The piston rod (5) is supported by a guide (14) which contains rinse bores (13). The guide (14) has axial bores to let the pump medium flow through. The radial rinse bores prevent solids from entering the gap and assure the mobility of the piston rod (5). For the same reason, rinse bores (12) are also found in the piston passage of the hydraulic cylinder (6).

It is possible to replace the axial bores of the guide (14) or the axial channels (10) of the hydraulic cylinder (6) by larger openings, and to design the remaining webs streamlined. A relatively large pumping cross-section can be achieved in this way.

The sealing surface of the valve body (4) is situated on that side which faces the piston (7), and finds its complement in the seat (15) of the valve housing (3). The seat (15) arises through a conical constriction of the valve housing (3) and possibly can also be provided with flexible gaskets(15*a*).

The valve body (4) has a streamlined shape in the form of a double cone. Because the flow is deflected so little, the through-flow resistance is especially low.

The fluid flows from the inlet of the bore-hole pump past the valve body (4), passes through the channels (10), to arrive at the actual inlet of the pump part.

Figure 2:
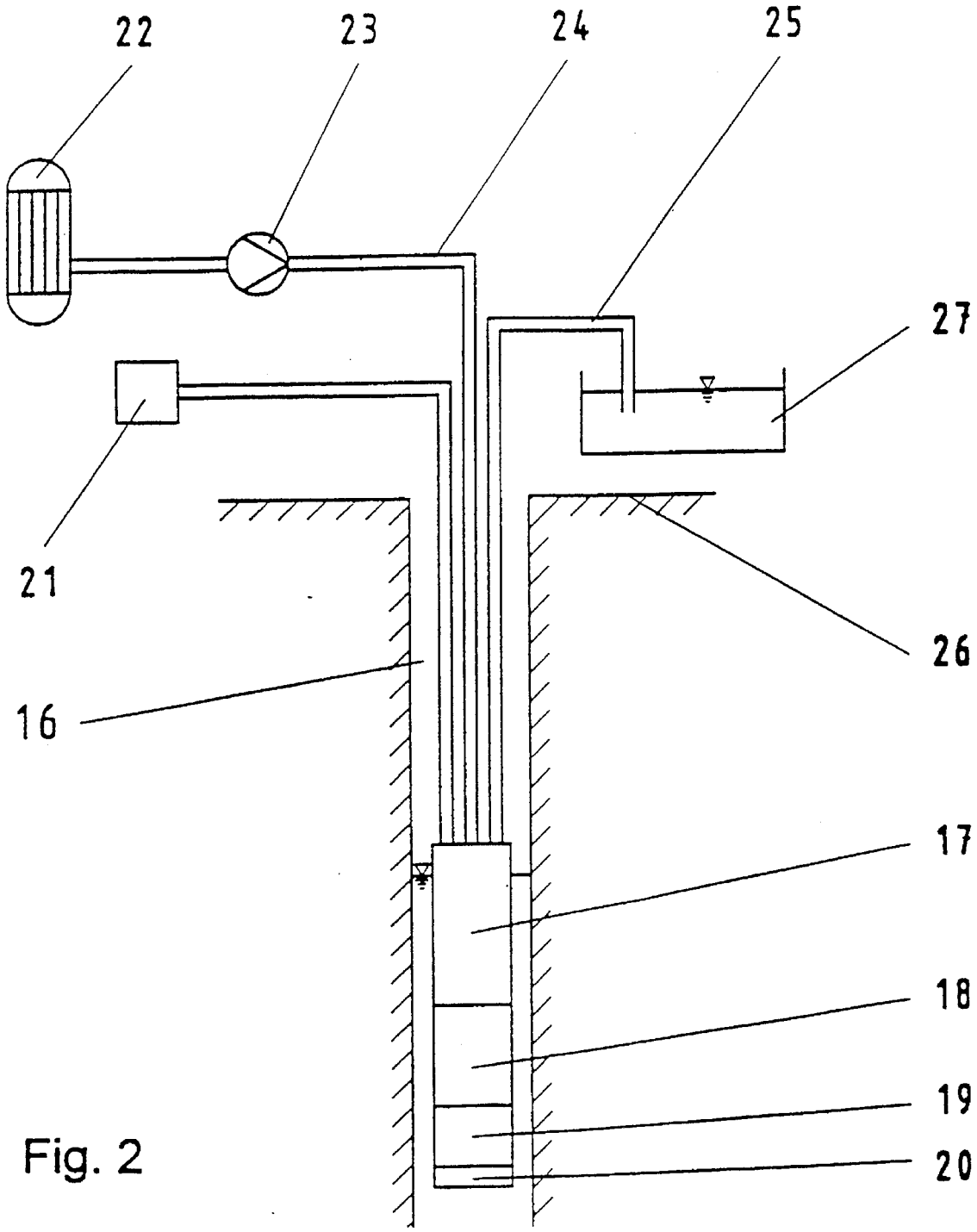
FIG. 2 shows a schematic arrangement of the bore-hole pump in a bore-hole width the supply equipment.

FIG. 2 shows an arrangement of a modular bore-hole pump in a bore-hole (16). The bore-hole pump consists of a motor (17), a pump part (18), and a shut-off device (19) with inlet (20). The motor (17) is fed power from the surface via a supply line (21). The solvent present in the container (22) is pressed by a pump (23) at the surface (26), via the line (24), into the bore-hole (16), and is entirely or partly admixed to the fluid. A pressure is available at the bore-hole pump, composed of the hydrostatic pressure and of the pressure applied by the pump (23) at the surface (26). The fluid, coming from the inlet (20) and pressing the shut-off device (19), is suctioned by the pump part (18), and is transported via a transport line (25) to the surface (26), where it is collected by means of an appropriate apparatus (27). In case of a turbo-pump, the supply line (21) for the drive fluid can coalesce with tile line (24) for the solvent.

The function of the shut-off device shown in the embodiment is explained below.

In its initial state, that is without the bore-hole pump being connected to its supply systems, the valve body (4) is pressed into its seat (15) by the pre-tensioned recess spring (11). The valve is thus closed. When the bore-hole pump is lowered into the bore-hole (16), the hydrostatic pressure, which increases with depth, acts on the valve body (4) and presses it more and more solidly into its seat (15). The viscous fluid is thus prevented from penetrating into the pump part. When the bore-hole pump is started up, solvent at high pressure is conducted into the channels (2*a*, 2*b*), and the valve opens. The piston (7) is here subjected to pressure from one side via the feed bore (8), and it moves against the spring force and against the force at the valve body (4), which is created by the hydrostatic pressure. The valve body (4) lifts from its seat (15) and allows the fluid to enter the pump part (18).

When the pump at the surface (23) is shut off, the piston (7) is subjected only to the hydrostatic pressure of the liquid column of solvent. The spring force and the hydrostatic pressure in the bore-hole (16), acting on the valve body (4), now push the valve body (4) back to the valve seat (15).

When the bore-hole pump is started up again, the starting torque of the pump part that is filled with the mixture of fluid and solvent must be overcome. For the rest, the initial start processes repeat.

The force relationships at the valve should be noted. After mounting, the valve is pressed into its seat (15) by the pre-tension of the reset spring (11). When the bore-hole pump is introduced, a force due to the fluid under hydrostatic pressure in the bore-hole and acting on the valve body (4) is added to the pre-tension force and reinforces the contact pressure against the seat (15).

To open the valve, solvent is applied to the piston (7). The solvent is under pressure, and in particular the hydrostatic pressure from the liquid column as well as a pressure component generated by the pump (23) at the surface (26). This pressure must generate a force that is greater than the sum of the spring force, of the reset spring (11), and of the force on the valve body (4). The pressure portion and the piston cross-section must be designed accordingly.

Operation with the valve open presupposes that the opening forces are and remain greater than the closing forces. However, since forces act on the valve body (4) both in the opening and in the closing direction, the force necessary for opening is reduced at the piston (7) and the pressure available for opening is in every case sufficient to keep the valve open.

To close the valve when the bore-hole pump is filled, the pressure component in the solvent, generated by the pump (23) at the surface (26), is reduced or eliminated. The spring force of the reset spring (11), together with the surface force on the valve body (4), that is created by the hydrostatic pressure in the bore-hole, must be greater than the force created by the hydrostatic pressure of the solvent in the piston (7), in order to bring the valve into its closed position. The spring force must be designed accordingly.

To open the valve against the flow direction, a force greater than that corresponding to the opposite opening direction is of course needed. However, this is counterbalanced by the advantage of safe shut-off in case of an accident. Additional pressure is then no longer applied to the piston (7), since the pump (23) at the surface (26) can no longer build up any pressure. Especially in the case of a safety-relevant fluid, automatic closure of the bore-hole pump in the event of failure of the above-ground supply apparatus is a very great advantage.

The solvent is admixed to the fluid after it passes the shut-off point, either in the shut-off device itself, in a subsequent mixing module, or otherwise.

I claim:

1. A bore-hole pump for pumping a highly viscous fluid, into which is fed a solvent which has a low viscosity and which is miscible with the fluid, wherein a shutoff device is disposed between an inlet of the bore-hole pump and an actual inlet of the pump part, the shut-off device is activated by the solvent.

2. The bore-hole pump of claim 1, wherein the shut-off device comprises a valve body, a piston rod, a hydraulic cylinder with a piston, and is housed in a valve housing with a valve seat.

3. The bore-hole pump of claim 2, wherein the valve body is pressed into the valve seat of the valve housing in the transport direction.

4. The bore-hole pump of claim 3, wherein the solvent is selectively applied to the piston, the valve body is pressed into the valve seat by a reset means, which is housed in a part of the hydraulic cylinder when the solvent fails to be applied to the piston.

5. The bore-hole pump of claim 3, wherein flexible gaskets are built into a valve seat of the valve body.

6. The bore-hole pump of claim 1, wherein the solvent drives a turbine associated with the bore-hole pump.

* * * * *

UNITED STATES PATENT AND TRADEMARK OFFICE

CERTIFICATE OF CORRECTION

PATENT NO. : 5,582,505

DATED : December 10, 1996

INVENTOR(S) : Helmut Warth

It is certified that error appears in the above-indentified patent and that said Letters Patent is hereby corrected as shown below:

On title page, item, [30], Foreign Application Priority Data, change "42 37 050.7" to --P 42 37 050.7--.

Signed and Sealed this

Twenty-second Day of April, 1997

Bruce Lehman

*Attest:*

BRUCE LEHMAN

*Commissioner of Patents and Trademarks*

*Attesting Officer*